United States Patent [19]

Nishida

[11] Patent Number: 4,733,627

[45] Date of Patent: Mar. 29, 1988

[54] CONTROL HANDLE FOR SMALL BOATS

[75] Inventor: Hiroshi Nishida, Higashi, Japan

[73] Assignee: Kawasaki Judogyo Kabushiki Kaisha, Kobe, Japan

[21] Appl. No.: 794,557

[22] Filed: Nov. 4, 1985

[30] Foreign Application Priority Data

Nov. 5, 1984 [JP] Japan ..... 59-233479

[51] Int. Cl.[4] ..... B63B 35/00

[52] U.S. Cl. ..... 114/270; 16/111 A

[58] Field of Search ..... 114/270; 440/88, 89; 180/19.1, 19.3; 16/111 A

[56] References Cited

U.S. PATENT DOCUMENTS 3,826,220 7/1974 Jacobson ..... 114/270

4,392,538 7/1983 Goertzen ..... 16/111 A

*Primary Examiner*—Joseph F. Peters, Jr.

*Assistant Examiner*—Jesûs D. Sotelo

*Attorney, Agent, or Firm*—Marshall, O'Toole Gerstein, Murray & Bicknell

[57] ABSTRACT

This disclosure relates to a small boat construction such as a recreational water scooter type. The boat includes a hull, a control handle, and a pivot connecting the handle to the hull, the pivot enabling the handle to be pivoted between a lowered position, an upright position and intermediate positions. The boat further includes a mechanism connected between the handle and the hull adjacent the pivot, the mechanism including a resistance mechanism effective for resisting movement of the handle to the upright position, and apparatus for canceling the resistance mechanism.

8 Claims, 7 Drawing Figures

CONTROL HANDLE FOR SMALL BOATS

FIELD AND BACKGROUND OF THE INVENTION

This invention deals with a control handle used on small boats such as water scooters and other relatively small one-man boats.

The prior art technology relating to such a control handle currently in use on small boats is set forth in Japanese Patent Publication No. SHO.51-35318. The handle described therein is a folding type which swings down close to the hull for convenient storage and transportation, and which swings up to allow for inspection and maintenance of the engine compartment. In addition, during operation of the boat, the height of the handle may be adjusted according to the posture of the operator.

SUMMARY OF THE INVENTION

In accordance with this invention, a control handle is provided which may be placed in a low position during storage of the small boat or in a high position during operation. Means is provided to offer resistance to movement when the control handle is moved from a low position to a high position, and to automatically return to the horizontal position when released, thus making operation of the boat easier. In addition, the resistance may be canceled by an operator when folding the handle up or down. Thus the resistance functions to soften the effects on the operator of impacts during operation of the boat, and it protects the boat from damage. Further, in the event that the boat overturns, the handle automatically returns to the horizontal position, thus making it easier to right the boat.

More specifically, a handle is provided for small boats which is capable of being raised and lowered between an upright position and a horizontal position, and a resistance mechanism is provided near the pivot point of the handle which creates a resistance when the handle is raised to the upright position and which also allows the resistance to be canceled when necessary. This resistance mechanism may be either a hydraulic cylinder or an elastic part.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
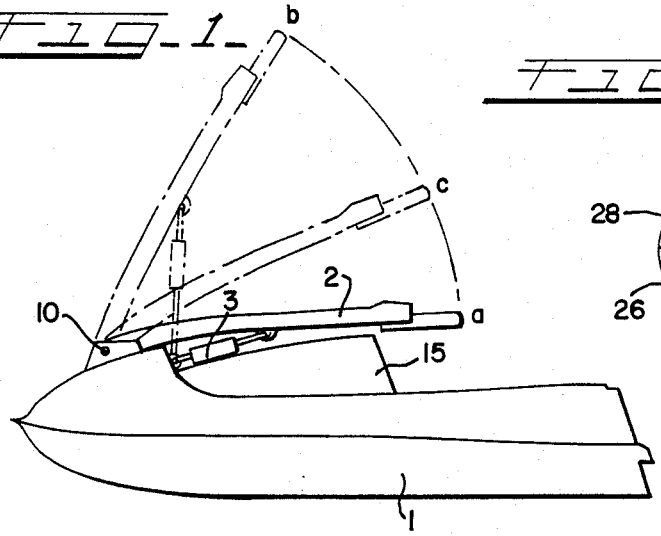
FIG. 1 shows a side view of a small boat including apparatus in accordance with this invention.
Figure 2:
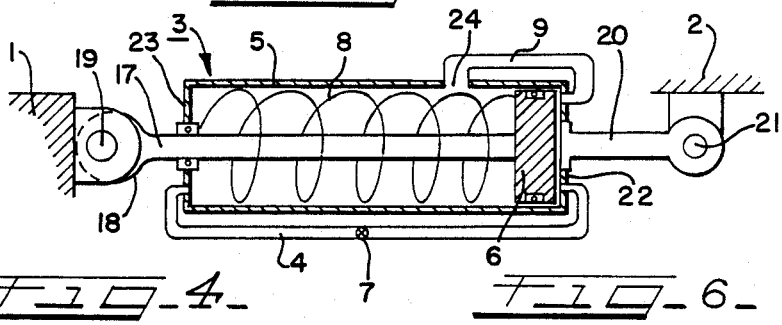
FIG. 2 is an enlarged cross-sectional view of one example of a resistance mechanism of the apparatus.

In FIGS. 1 and 2, a control handle 2 is pivotably attached to the upper side of the hull 1 of a boat by a pivot pin or shaft 10, and the folding design of the handle 2 allows it to be moved between a horizontal position (a) shown in solid lines, an upright position (b) shown in dash-dot lines, and intermediate positions (c). A resistance mechanism 3 is connected between the base of the handle 2 and the upper side of the hull. Although the handle 2 can be moved from the horizontal position (a) to an intermediate centrol position (c) with almost no resistance, resistance is applied when it is moved from the central position (c) to the upright position (b). When the handle 2 is in position (a), it is folded down close to the cover 15 of the engine compartment; when it is in the raised position (b) the cover 15 may be removed for engine inspection; when in position (c) the handle is located for normal operation.

FIG. 2 shows a first embodiment of the resistance mechanism 3. An air cylinder 5 contains an axially movable piston 6, and the end 18 of the piston rod 17 is pivotably connected to the hull 1 by a pin 19, while the closed end 22 of the cylinder 5 is connected by a link 20 and a pivot pin 21 to the handle 2. A compression spring 8 is mounted between the piston 6 and the rod end 23 of the cylinder, and the cylinder is filled with air. A bypass pipe 4 is connected between the ends 22 and 23 of the cylinder 5 and a valve 7 is mounted in the pipe 4. The valve 7 is manually movable between open and closed positions. A second bypass pipe 9 is connected between the closed end 22 and an intermediate port 24 on the cylinder. When the boat is not being used, the valve 7 may be manually opened to allow the action of the spring 8 inside the cylinder to contract the resistance mechanism by drawing the piston into the cylinder, and hold the handle in the horizontal position.

Considering further the functioning of the embodiment shown in FIG. 2, when the boat is to be placed in use, the valve 7 in the bypass pipe 4 is manually closed and the control handle 2 (FIG. 1) is raised. The bypass pipe 9 on the cylinder 5 allows the piston 6 to displace air freely for a fixed stroke length until the piston 6 reaches the port 24 of the bypass pipe 9, and consequently there is almost no resistance (except that of the spring 8) when the handle 2 is moved from the horizontal postion (a) to the central position (c) at which point the piston 6 closes the port 24. If the handle 2 is moved further from the central position (c) to the upright position (b), because the bypass pipe 4 is closed by the valve 7, the air trapped inside the cylinder 5 to the left of the piston 6 is compressed as the piston 6 moves, thus creating a resistance to the movement. The handle 2 can be set to a specific position by moving it to that position and manually opening and then reclosing the valve 7. Also if the valve 7 is manually opened, the handle pole 2 can be raised and lowered freely.

Figure 3:
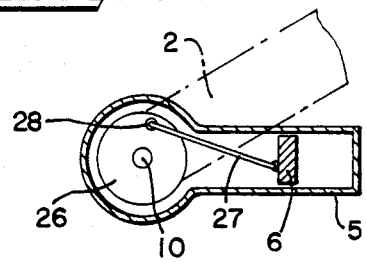
FIGS. 3 and 4 show cross-sectional views of second and third forms of the apparatus.
Figure 4:
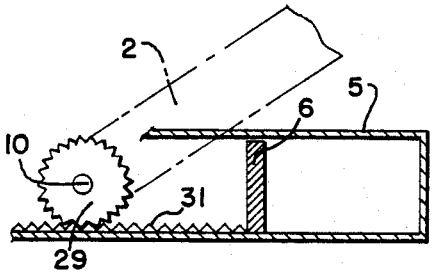

The above is a description of apparatus including a hydraulic (air) cylinder as the resistance mechanism, but other types of resistance mechanisms may be used. FIGS. 3 and 4 show two additional examples of cylinder-type mechanisms.

In FIG. 3, the handle 2 is attached to the hull by a pivot shaft 10. An air cylinder 5 has a piston 6 and is fastened to the hull 1. A crank arm 27 has one end attached to the piston 6 and its other end connected to a part 26 of the handle 2 at the point 28. The arm 27 is at an angle to the cylinder axis and the cylinder encloses the arm 27 and the part 26 which is rotatable on the shaft 10. When the handle 2 is raised, the air inside the cylinder 5 and to the left of the piston 6 is compressed by the piston 6, so that resistance is applied when the handle 2 is raised. Although the action of the cylinder is generally the same as the cylinder in FIG. 2, the advantage of the cylinder 5 of FIG. 3 is that it can be incorporated partially inside the handle 2 and not be exposed on the outside of the handle and the deck.

In the mechanism of FIG. 4, the handle's pivot shaft 10 is also used as a pinion shaft. A pinion 29 is secured to and rotates with the shaft 10 and the handle 2. A rack 31 is attached to a piston 6 inside of an air cylinder 5 which is fastened to the deck 1. The rack 31 is intermeshed with the pinion 29 and it is moved toward the right when the handle 2 is raised, thus causing the air inside the cylinder 5 to the right of the piston 6 to be compressed by the piston 6, and thereby applying resistance to the upward movement of the handle.

While not shown or described in connection with FIGS. 3 and 4, the cylinders 5 in these two figures are also provided with bypass pipes 4 and 9, a valve 7 and a spring 8 so that the resistance to motion is small when the handle is in lowered position and increased when the handle is raised.

Figure 5A:
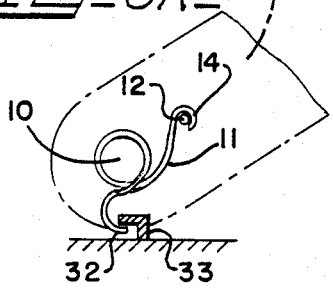
FIGS. 5(A) and 5(B) show a side view and a front view respectively of a fourth form of the apparatus.
Figure 5B:
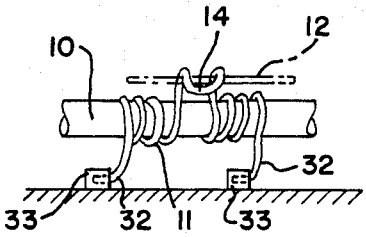

In addition to hydraulic (air) cylinder mechanisms, elastic members can also be used as part of the resistance mechanism. FIGS. 5(A) and 5(B) show an example of a coiled torsion spring 11 wrapped around the handle's pivot shaft 10. The ends 32 of the coil spring 11 engage brackets 33 attached to the hull, and a center part of the spring is bent in the shape of a hook 14. A rod 12 is attached to the handle 2 and is located to be engaged by the hook 14. When the handle 2 is at the central position, the hook 14 engages the rod 12 in the handle pole and the ends 32 engage the brackets 33, thus causing a tensioning of the coil spring 11 and a resistance to the movement of the handle from the central position to the upright position. When the handle is between the positions (a) and (c), the ends 32 of the spring are out of engagement with the brackets 33 and there is no resistance to movement of the handle. In addition, the design can be adjusted to release the spring 11 when the handle pole is raised approximately upright, such as by sliding the spring toward the right as seen in FIG. 5(B) until the ends 32 disengage from the brackets 33. Means may also be provided on the handle to keep it upright without allowing it to fall down.

Figure 6:
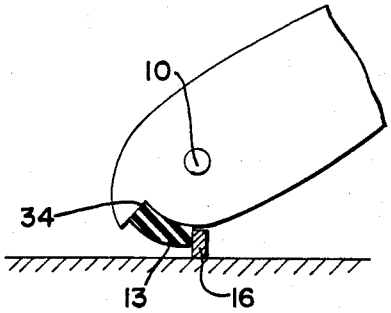
FIG. 6 shows a side view of a fifth form of the apparatus.

In FIG. 6, a section 13 of an elastic substance (for example, rubber) is mounted on the outside of the handle 2 adjacent the pivot shaft 10, and abuts a cam 34 formed on the bottom of the handle 2. A stop 16 is fastened to the hull 1 below the bottom of the handle. When the handle 2 is in the lowered position, the section 13 is out of engagement with the stop 16. When the handle is raised above the position (c), the elastic section 13 is compressed to create resistance to the continued movement of the handle to the upright position. To cancel the resistance, the stop 16 attached to the hull can be slid on the deck to one side of the part 13.

It will be apparent from the foregoing that an advantageous invention has been provided. The invention includes a resistance mechanism installed near the pivot shaft of the control handle on small boats, which applies a resistance to the raising of the handle pole above the central position while allowing it to be raised freely from the horizontal position to the central position. The resistance mechanism urges the handle toward the horizontal position (the storage position) when it is released, so that even if the boat is overturned, the handle is held in the horizontal position, thus lowering the center of gravity and making it easier to right the boat. The resistance mechanism is also effective in softening the force transmitted to the operator from the impact of the waves on the boat during operation. In addition, the resistance mechanism can be easily released to enable raising of the handle in order to open and close the cover or hood 15 for inspection and maintenance.

What is claimed is:

1. Apparatus for use with a small boat including a hull, a control handle, and pivot means connecting the handle to the hull, said pivot means enabling said handle to be pivoted between a lowered position, an upright position and an intermediate position, said apparatus comprising a mechanism adapted to be connected between said handle and said hull adjacent said pivot means, said mechanism including resistance means effective for resisting movement of said handle to said upright position, and means for canceling said resistance means, said resistance means comprising a hydraulic cylinder and piston adapted to be connected between said handle and said hull.

2. Apparatus as in claim 1, wherein said canceling means comprises a bypass pipe connected to said cylinder on opposite sides of said cylinder and a valve in said bypass pipe.

3. Apparatus for use with a small boat including a hull, a control handle, and pivot means connecting the handle to the hull, said pivot means enabling said handle to be pivoted between a lowered position, an upright position and an intermediate position, said apparatus comprising a mechanism adapted to be connected between said handle and said hull adjacent said pivot means, said mechanism including resistance means effective for resisting movement of said handle to said upright position, and means for canceling said resistance means, said resistance means comprising a torsion spring having its ends adapted to be connected between said handle and said hull, and said canceling means including means for disengaging at least one of said ends from said handle and said hull.

4. Apparatus for use with a small boat including a hull, a control handle, and pivot means connecting the handle to the hull, said pivot means enabling said handle to be pivoted between a lowered position, an upright position and an intermediate position, said apparatus comprising a mechanism adapted to be connected between said handle and said hull adjacent said pivot means, said mechanism including resistance means effective for resisting movement of said handle to said upright position, and means for canceling said resistance means, said resistance means comprising an elastic part adapted to be connected between stops on said handle and said hull, and said canceling means including means for moving at least one of said stops out of engagement with said elastic part.

5. Apparatus for use with a small boat including a hull and pivot means on said hull, said apparatus comprising a control handle adapted to be connected to said pivot means for pivoting movement between a lowered position and an upright position, and resistance means connected to said handle and adapted to be connected to said hull, said resistance means being operable to resist movement of said handle toward said upright position, and means for canceling said resistance means, said resistance means comprising a hydraulic cylinder.

6. Apparatus for use with a small boat including a hull and pivot means on said hull, said apparatus comprising a control handle adapted to be connected to said pivot means for pivoting movement between a lowered position and an upright position, and resistance means connected to said handle and adapted to be connected to said hull, said resistance means being operable to resist movement of said handle toward said upright position, and means for canceling said resistance means, said resistance means comprising a torsion spring.

7. Apparatus for use with a small boat including a hull and pivot means on said hull, said apparatus comprising a control handle adapted to be connected to said pivot means for pivoting movement between a lowered position and an upright position, and resistance means connected to said handle and adapted to be connected to said hull, said resistance means being operable to resist movement of said handle toward said upright position, and means for canceling said resistance means, said resistance means comprising an elastic part.

8. A small boat comprising a hull, a control handle, pivot means connecting said handle about a substantially horizontal axis at the forward end of said hull, said pivot means enabling said handle to be pivoted from a lowered position, through an intermediate position and to an upright position, and a mechanism connected between said handle and said hull adjacent said pivot means, said mechanism including resistance means yieldably allowing movement of said handle from said intermediate position to said upright position while urging said handle toward said lowered position only while said handle is between said intermediate and upright positions.

* * * * *